US006228821B1

(12) United States Patent
Sliva

(10) Patent No.: US 6,228,821 B1
(45) Date of Patent: May 8, 2001

(54) CLEANING COMPOSITION HAVING ENHANCED FRAGRANCE AND METHOD OF ENHANCING FRAGRANCE

(75) Inventor: Philip G. Sliva, Rockford, MI (US)

(73) Assignee: Amway Corporation, Ada, MI (US)

( * ) Notice: Subject to any disclaimer, the term of this patent is extended or adjusted under 35 U.S.C. 154(b) by 0 days.

(21) Appl. No.: 09/426,373

(22) Filed: Oct. 25, 1999

(51) Int. Cl.[7] ..... C11D 3/34
(52) U.S. Cl. ..... 510/101; 510/495
(58) Field of Search ..... 510/101, 367, 510/369, 495

(56) References Cited

U.S. PATENT DOCUMENTS

| | | | |
|---|---|---|---|
| H1468 | 8/1995 | Costa et al. . | |
| 4,954,285 | 9/1990 | Wierenga et al. . | |
| 4,992,198 | 2/1991 | Nebashi et al. . | |
| 5,234,610 | 8/1993 | Gardlik et al. . | |
| 5,614,484 | 3/1997 | Panandiker . | |
| 5,649,979 | 7/1997 | Paget et al. . | |
| 5,656,584 | 8/1997 | Angell et al. . | |
| 5,670,466 | 9/1997 | Sivik et al. . | |
| 5,691,298 * | 11/1997 | Gosselink et al. | 510/475 |
| 5,721,202 | 2/1998 | Waite et al. . | |
| 5,726,345 | 3/1998 | Paget et al. . | |
| 5,739,091 | 4/1998 | Kiesser et al. . | |
| 5,780,404 | 7/1998 | Bacon et al. . | |
| 5,783,544 | 7/1998 | Trinh et al. . | |
| 5,830,839 * | 11/1998 | Scepanski | 510/305 |
| 5,858,952 | 1/1999 | Izawa et al. . | |
| 5,858,959 | 1/1999 | Surutzidis et al. . | |

* cited by examiner

*Primary Examiner*—John Hardee
(74) *Attorney, Agent, or Firm*—Brinks Hofer Gilson & Lione; G. Peter Nichols

(57) ABSTRACT

A cleaning composition includes ingredients useful for formulating laundry and cleaning compositions selected from the group consisting of cationic or nonionic fabric softening agents, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof; an enzyme; a perfume; and an effective amount of a stabilizer to provide an enhanced perfume effect. The stabilizer is selected from the group of antioxidants, reducing agents, and mixtures thereof.

6 Claims, No Drawings

CLEANING COMPOSITION HAVING ENHANCED FRAGRANCE AND METHOD OF ENHANCING FRAGRANCE

The present invention relates to cleaning compositions having enhanced fragrance retention and to a method of enhancing the fragrance retention of a cleaning composition.

Consumer acceptance of cleaning and laundry products is determined not only by the performance achieved with these products but also with their aesthetics. In the art of cleaning compositions, formulators have used enzymes for a variety of purposes, including removal of protein-based, carbohydrate-based, or triglyceride-based stains, and for the prevention of refugee dye transfer, and for fabric restoration. Typically, enzymes such as proteases, amylases, lipases, cellulases, and peroxidases have been used for such purposes.

These enzymes are usually incorporated in the form of granules so as not to lose their activity during storage and to sufficiently exhibit their activities during use. The enzymatic stability of such enzyme-containing granulated products decreases when the granulated products are blended with bleaching agents, surfactants, builders for detergents, or similar materials. In particular, it is known that enzyme activity decreases considerably when a granulated product is blended with a bleaching agent.

Proposed solutions to prevent the reduction of enzyme activity include providing a reducing agent or an antioxidant either separate from the enzyme or by providing, in a uniformly dispersed state, an enzyme, and a stabilizing agent, such as a reducing agent or an antioxidant.

Another drawback to the use of enzymes in cleaning compositions is the unpleasant odor that such enzymes contribute. Likewise, the feedstocks in which the enzymes are usually contained and delivered also contribute to unpleasant odors. These enzymes and their feedstocks are complex mixtures obtained from fermentation processes and they typically contain many offensive odor contaminants that ultimately find their way into the cleaning compositions in which the enzymes are included. The resulting malodors in such cleaning compositions do not appeal to consumers. Additionally, the detergency enzymes have a tendency to leave residual odors on fabrics when, for example, the cleaning composition is a detergent composition. These residual odors lead to consumer dissatisfaction.

In addition, the detergent raw materials can contribute unpleasant or undesirable odors to the compositions as well as to fabrics. As the compositions age, these odors can become more pronounced.

In the past, these drawbacks have often been countered by limiting the level of enzyme used in the composition. This approach, however, restricts product efficacy and does not entirely eliminate the malodor problem. Another approach entails "purifying" the enzyme to reduce the amount of malodor constituents in the enzyme itself prior to combining with the cleaning compositions. More particularly, cleaning compositions containing enzymes have been purified such that they do not have a detectable odor in distilled water at specified concentration levels. While this approach provides a viable option, it requires an additional step in the manufacture of the cleaning composition (i.e., the purifying step), resulting in a more expensive product.

As a result, perfumes or fragrances are used to mask the odors caused by the enzyme-containing cleaning compositions. The perfume or fragrance is therefore an important aspect of the successful formulation of such commercial products. What perfume or perfume system to use for a given product is a matter of careful consideration by skilled perfumers. While a wide array of chemicals and ingredients are available to perfumers, considerations such as availability, cost, and compatibility with other components in the compositions limit the practical options.

Over time, however, the perfume or fragrance can itself be degraded or overcome as the objectionable odors of the enzymes and/or other ingredients of cleaning compositions increase.

Thus, there continues to be a need for a low-cost method for maintaining and retaining the fragrance of enzyme-containing cleaning compositions. The present invention provides such a method and a resulting composition. In particular, the present invention provides a method for maintaining and enhancing the fragrance of an enzyme-containing cleaning composition by providing low-levels of an antioxidant or reducing agent. Surprisingly, it has been found that the low levels contemplated for use in the present invention enhance and aid in retaining the fragrance effect of fragrance added to cleaning composition. This effect is surprising because the desired effect is not attained when higher levels of the antioxidant and/or reducing agent are used.

The present invention also provides a cleaning composition containing an enzyme, a fragrance, and a low level of an antioxidant and/or reducing agent.

SUMMARY OF THE INVENTION

In accordance with the present invention, a novel cleaning composition is provided that includes cleaning ingredients useful for formulating cleaning compositions, an enzyme, a perfume, and an effective amount of a stabilizer to provide an enhanced perfume effect, such that the stabilizer is selected from the group of antioxidants, reducing agents, and mixtures thereof. The cleaning ingredients useful for formulating cleaning compositions are selected from the group consisting of cationic or nonionic fabric softening agents, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof.

The cleaning compositions include laundry and dishwashing detergents, hard surface cleaners, and other types of cleaners having cleaning composition ingredients and enzymes. The cleaning composition can be a powder or may be a liquid.

In general, where the cleaning composition is in a powder form the cleaning ingredients comprise the majority amount of the cleaning compositions. In this case, the cleaning ingredients comprise from about 5% to about 99% of the cleaning composition. Where the cleaning composition is in a liquid form, a liquid carrier is present in typical amounts from about 40% to about 90% of the cleaning composition. In this case, the cleaning ingredients comprise the majority of the remaining ingredients.

The enzymes are present in amounts typically used in cleaning compositions. In particular, the enzymes are present in an active amount from about 0.00001% to about 1% by weight of the cleaning composition. Alternatively, where the enzymes are supplied as granules (as is commercially customary), the enzyme granules are present in an amount from about 0.05% to about 10% by weight of the cleaning composition.

Likewise, the perfume is present in amounts typically used in cleaning compositions. In particular, the perfume is present in an amount from about 0.01% to about 5% by weight of the cleaning composition.

The stabilizer is present in an amount no greater than 10 ppm in the cleaning composition. In other words, the stabilizer is present in an amount from about 0.0000001% to 0.001% by weight of the cleaning composition. A preferred amount is from about 0.0001 to 0.001% by weight of the cleaning composition.

All percentages, ratios and proportions herein are on a weight basis unless otherwise indicated. All documents cited herein are hereby incorporated by reference.

The terms perfume and fragrance are used interchangeably.

DETAILED DESCRIPTION OF THE INVENTION

The cleaning compositions of this invention includes ingredients useful for preparing cleaning compositions, an enzyme, a perfume or fragrance, and an effective amount of a stabilizer to provide an fragrance effect, wherein the stabilizer is selected from the group consisting of antioxidants, reducing agents, and mixtures thereof.

The cleaning compositions of the present invention include liquid, granular, and bar laundry and cleaning products, which are typically used for laundering fabrics and cleaning hard surfaces such as dishware and other surfaces in need of cleaning and/or disinfecting.

The cleaning ingredients useful in the cleaning compositions of the present invention include but are not limited to cationic or nonionic fabric softening agents, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof. The particular ingredients will be described in more detail below after the description of the enzymes, fragrance, and stabilizers.

Enzyme

Enzymes can be included in the compositions of the present invention for a variety of purposes, including removal of protein-based, carbohydrate-based, or triglyceride-based stains from surfaces such as textiles or dishes, for the prevention of refugee dye transfer, for example in laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry, hard surface cleaning or personal care cleaning compositions. Preferred detersive enzymes are hydrolases such as proteases, amylases and lipases. Preferred enzymes for laundry purposes include, but are not limited to, proteases, cellulases, lipases and peroxidases. Preferred automatic dishwashing enzymes are amylases and/or proteases, including both current commercially available types and improved types which, though more and more bleach compatible though successive improvements, have a remaining degree of bleach deactivation susceptibility.

Suitable examples of proteases include pepsin, trypsin, chymotrypsin, collagenase, keratinase, elastase, subtilisin, papain, aminopeptidase, and carboxypeptidase. For example, the subtilisins may be obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE®; as well as Protease A as disclosed in EP 130,756 A and Protease B as disclosed in EP 303,761 A and EP 130,756 A. A high pH protease from Bacillus sp. NCIMB 40338 described in WO 9318140 A to Novo may also be useful. Enzymatic detergents comprising protease, one or more other enzymes, and a reversible protease inhibitor are described in WO 9203529 A to Novo. A recombinant trypsin-like protease for detergents suitable herein is described in WO 9425583 to Novo.

Specific examples of carbohydrases include cellulase, maltase, saccharase, amylase, pectitase, and α- and β-glycosidases.

Amylases suitable herein, especially for, but not limited to automatic dishwashing purposes, include, for example, α-amylases described in GB 1,296,839 to Novo; RAPIDASE®, and TERMAMYL®, Novo. FUNGAMYL® from Novo may also be useful. Engineering of enzymes for improved stability, e.g., oxidative stability, is known. See, for example J. Biological Chem., Vol. 260, No. 11, June 1985, pp. 6518–6521. The present compositions may make use of amylases having improved stability in cleaning compositions such as automatic dishwashing types, especially improved oxidative stability as measured against a reference-point of TERMAMYL® in commercial use in 1993.

These amylases share the characteristic of being "stability-enhanced" amylases, characterized, at a minimum, by a measurable improvement in one or more of: oxidative stability, e.g., to hydrogen peroxide/tetraacetylethylenediandne in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the *Baccillus amylases*, especially the *Bacillus α-amylases*, regardless of whether one, two or multiple amylase strains are the immediate precursors. Oxidative stability-enhanced amylases versus the above-identified reference amylase may be preferred for use, especially in bleaching, more preferably oxygen bleaching, as distinct from chlorine bleaching, detergent compositions herein.

Such preferred amylases may include (a) an amylase according to WO 9402597, as further illustrated by a mutant in which substitution is made, using alaninc or threonine, preferably threonine, of the methionine residue located in position 197 of the *B. lichenifonnis alpha-amylase*, known as TERMAMYL®, or the homologous position variation of a similar parent amylase, such as *B. amyloliquefaciens, B. subtilis*, or *B. stearothermophilus*; (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. It was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) amylase variants having additional modification in the immediate parent as described in WO 9510603 A are available from Novo as DURAMYL®. Other oxidative stability enhanced amylase include those described in WO 94183 14 to Genencor International and WO 9402597 to Novo. Any other oxidative stability-enhanced amylase may be used, for example as derived by site-directed mutagenesis from known chimeric, hybrid or simple mutant parent forms of available amylases. Other preferred enzyme modifications are accessible. See WO 9509909 A to Novo.

Cellulases usable herein include both bacterial and fungal types, preferably having a pH optimum between 5 and 9.5. U.S. Pat. No. 4,435,307, Barbesgoard et al, discloses suitable fungal cellulases from *Humicola insolens* or *Humicola strain* DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® (Novo) may also be useful.

Specific examples of esterases include gastric lipase, pancreatic lipase, lipases of vegetable origin, phospholipases, choline esterases, and phosphatases.

Suitable lipase enzymes for detergent usage include those produced by microorganisms of the Pseudomonas group, such as Pseudomonas stutzeri ATCC 19.154, as disclosed in GB 1,372,034. See also lipases in Japanese Patent Application 53,20487. This lipase is available from Amano Pharmaceutical Co. Ltd., Nagoya, Japan, under the trade name Lipase P "Amano," or "Amano-P." Other suitable commercial lipases may include Amano-CES, *lipases ex Chromobatter viscosum*, e.g. *Chromobacter viscosum vat. lipolyticum* NRRLB 3673 from Toyo Jozo Co., Tagata, Japan; *Chromobacter viscosum lipases* from U.S. Biochemical Corp., U.S.A. and Disoynth Co., The Netherlands, and *lipases ex Pseudomonas gladioli*. LIPOLASE® enzyme derived from *Humicola lanuginosa* and commercially available from Novo, see also EP 341,947, may be used. Lipase and amylase variants stabilized against peroxidase enzymes are described in WO 9414951 A to Novo.

Cutinase enzymes that may be used in the composition are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139. Enzymes are further disclosed in U.S. Pat. No. 4,101,457 and in U.S. Pat. No. 4,507,219. Enzyme materials useful for liquid detergent formulations, and their incorporation into such formulations, are disclosed in U.S. Pat. No. 4,261,868. Enzymes for use in detergents can be stabilized by various techniques. Enzyme stabilization techniques are disclosed and exemplified in U.S. Pat. No. 3,600,319, EP 199,405 and EP 200,586. Enzyme stabilization systems are also described, for example, in U.S. Pat. No. 3,519,570. A useful Bacillus, sp. AC13 giving proteases, xylanases and cellulases, is described in WO 9401532 A to Novo.

Enzymes that are used in the present invention are not particularly limited so long as they can be incorporated into the cleaning compositions of the present invention.

Enzymes are normally incorporated into cleaning compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. Where the enzyme is a cellulase, it is generally incorporated in a cleaning composition in an amount to provide "pill" removal. In practical terms, the amount of the enzyme granule is present in an amount from about 0.05% to about 10% by weight. In other words, the active amount of the enzyme present in the composition is from about 0.00001% to about 1% by weight.

For certain cleaning compositions, such as in automatic dishwashing, it may be desirable to increase the active enzyme content in order to minimize the total amount of non-catalytically active materials and thereby improve desired end-results. Higher active levels may also be desirable in highly concentrated cleaning composition formulations.

Perfume

The composition comprises from about 0.01% to about 10% by weight of the cleaning composition of a perfume component. The perfume component typically comprises from about 0.01% to about 10%, preferably from about 0.05% to about 5%, and more preferably from about 0.1% to about 5%, by weight of the composition.

The perfume or fragrances suitable for use in the present invention are those generally known to those of skill in the art. For example the perfume can include the sulfonate and/or sulfonates of perfume alcohol and/or alcohols.

The perfume may also include one or more additional fully, or partially esterified esters of a perfume alcohol. Examples of such esterified esters of perfume alcohols are the di-esters of perfume alcohols such as digeranyl succinate, dineryl succinate, geranyl neryl succinate, geranyl phenylacetate, neryl phenylacetate, geranyl laurate, neryl laurate, di(b-citronellyl) maleate, dinonadol maleate, diphenoxyanol maleate, di(3,7-dimethyl-1-octanyl) succinate, di(cyclohexylethyl) maleate, diflralyl succinate, and di(phenylethyl) adipate, and mixtures thereof.

The perfume ingredients may also including but are not limited to: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenylbutanone; benzophenone; methyl beta-naphthyl ketone; 6-acetyl-1,1,2,3,3,5hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl ocatanal; 10-undecen-1-al; isohexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin; heliotropin; hexyl cinnamic aldehyde; amyl cinnamic aldehyde; 2-methyl-2-(para-iso-propylphenyl)propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; beta-naphthol methyl ether; ambroxane; dodecahydro-3a,6,6,9a-tetramethyinaphtho[2,1b]furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Other perfume materials may include essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin and lavender. Still other perfume chemicals include phenyl ethyl alcohol, terpineol, linalool, linalyl acetate, geraniol, nerol, 2-(1,1-dimethylethyl)cyclohexanol acetate, benzyl acetate, orange terpenes, eugenol, diethylphthalate.

Stabilizer

The stabilizer may be selected from the group consisting of antioxidants, reducing agents, and mixtures thereof. The stabilizers that may be useful in the present compositions are those well known in the art and may include those that are later developed.

Examples of reducing agents include alkali metal salts (such as sodium salts and potassium salts) and alkaline earth metal salts (such as calcium salts and magnesium salts) of boric acid, sulfurous acid, thiosulfuric acid, etc. Specifically, sodium tetraborate, sodium sulfite, and sodium thiosulfate may be used. Specific examples of antioxidants include ascorbic acid, sodium ascorbate, erythorbic acid, sodium erythorbate, dl-α-tocopherol, isopropyl citrate, butylated hydroxytoluene (BHT), butylated hydroxyanisol (BHA), tannic acid, and sulfur-containing antioxidants.

The stabilizer may be used at a level of from 0.0000001% to 1%, by weight of the cleaning composition, preferably from about 0.0001% to 0.001%. Surprisingly, it has been found that at levels greater than 0.001% the advantageous results achieved by adding the stabilizer is not achieved. In other words, it has been found that the use of the stabilizer at levels greater than 10 ppm in the cleaning composition does not produce an enhanced fragrance effect. In fact, it has been found that the presence of a stabilizer (a thiosulfate antioxidant) at levels of about 30 ppm in the cleaning composition caused the resulting composition to have an objectionable odor despite the presence of 2000 ppm fragrance in the cleaning composition.

The stabilizer may be separately added to the other ingredients comprising the cleaning compositions of the present invention. Alternatively, the stabilizer may be combined with another ingredient incorporated in the cleaning compositions. For example, the stabilizer may be provided as a granulated enzyme particle. Methods of making such granulated particles may include drying a solution containing an enzyme and a stabilizer and then granulating, subjecting a solution containing an enzyme and a stabilizer to a wet granulation process, or blending an enzyme powder and a stabilizer in powder form, followed by granulation.

Alternatively, the stabilizer and enzyme may be provided "in a uniformly dispersed state". That is, the enzyme and a stabilizer are not necessarily in a dispersed state on the molecular level but they may be present as a dispersed powder.

Cleaning ingredients

As noted above, the cleaning ingredients useful in the cleaning compositions of the present invention include but are not limited to cationic or nonionic fabric softening agents, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof. In general, these cleaning ingredients are known to those of skill in the art. In addition, one of skill in the art will understand how to incorporate such cleaning ingredients in cleaning compositions.

Surfactants

Detersive surfactants can be included in the compositions of the present invention. Such compositions may comprise at least 1%, preferably from about 1% to about 99.8%, by weight of surfactant depending upon the particular surfactants used and the effects desired. In a highly preferred embodiment, the detersive surfactant comprises from about 5% to about 80% by weight of the composition.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants. Nonlimiting examples of surfactants useful herein include the conventional $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts and are identified in McCutcheons, the relevant portions of which are incorporated herein by reference.

One class of nonionic surfactant particularly useful in detergent compositions of the present invention is condensates of ethylene oxide with a hydrophobic moiety to provide a surfactant having an average hydrophilic-lipophilic balance (HLB) in the range of from 5 to 17, preferably from 6 to 14, more preferably from 7 to 12. The hydrophobic (lipophilic) moiety may be aliphatic or aromatic in nature. The length of the polyoxyethylene group that is condensed with any particular hydrophobic group can be readily adjusted to yield a water-soluble compound having the desired degree of balance between hydrophilic and hydrophobic elements.

Especially preferred nonionic surfactants of this type are the $C_6$–$C_{18}$ primary or secondary alcohol ethoxylates containing 3–8 moles of ethylene oxide per mole of alcohol. Another suitable class of nonionic surfactants comprises the polyhydroxy fatty acid amides of the formula:

$$R^2C(O)_n(R^1)Z$$

wherein: $R^1$ is H, $C_1$–$C_8$ hydrocarbyl, 2-hydroxyethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{32}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_n—1—CH_2OH$, $—H_2—CHOH)_2(CHOR^2)(CHOH)—CH_2OH$, where n is an integer from 1 to 5, inclusive, and $R^2$ is H or a cyclic mono- or polysaccharide, and alkoxylated derivatives thereof. Most preferred are glycityls wherein n is 4, particularly $—CH_2—(CHOH)_4—CH_2OH$.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839. Na SKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSixO_2x+1.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates are disclosed in German Patent Application No. 2,321,001.

Aluminosilicate builders may be useful in the present invention. Aluminosilicate builders include those having the empirical formula:

$$Mzx(zAIO_2)y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally occurring aluminosilicates or synthetically derived. A method for producing aluminosilicate ion exchange materials is disclosed in U.S. Pat. No. 3,985,669. For example, synthetic crystalline aluminosilicate ion exchange materials useful herein are available under the designations Zeolite A, Zeolite P (B), Zeolite MAP and Zeolite X.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287, and U.S. Pat. No. 3,635,830. See also "TMS/TDS" builders of U.S. Pat. No. 4,663,071. Ether polycarboxylates include cyclic compounds, particularly allcyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloiysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy-duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the compositions of the present invention are the 3,3-dicarboxy4-oxa-1,6-hexanedioates and the related compounds disclosed in U.S. Pat. No. 4,566,984. Useful succinic acid builders include the $C_5$–$C_{20}$ alkyl and alkenyl succinic acids and salts thereof such as dodecenylsuccinic acid. Specific examples of succinate builders include: laurylsuccinate, myristylsuccinate, palmitylsuccinate, 2-dodecenylsuccinate, 2-pentadecenylsuccinate, and the like.

Other suitable polycarboxylates are disclosed in U.S. Pat. No. 4,144,226 and U.S. Pat. No. 3,308,067.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

When the cleaning composition of the present invention is provided in a powder or granulated form, it may contain, in addition to the above-mentioned components, other ingredients needed for granulation. Such additives include binders, particularly water-soluble organic binders. The following may be cited as examples of water-soluble organic binders that may be used together with the mentioned essential components of the present invention: (a) water-soluble polymers selected from the group consisting of polyethylene glycol having a melting point of not lower than 35° C., derivatives thereof, and polyoxyethylene polyoxypropylene copolymers; (b) nonionic surfactants having a melting point or pour point of not lower than 35° C.; and (c) polycarboxylates having a mean molecular weight of not less than 4,000. These may be used singly, or in combinations of two or more.

Specific examples of particularly preferred water-soluble organic binders include, among the class of polyethylene glycol and its derivatives (a), polyethylene glycol, polyethylene glycol sulfate, and methoxypolyethylene glycol; among the class of nonionic surfactants (b), polyoxyethylene alkyl ethers; and among the class of polycarboxylates (c), alkali metal salts of polyacrylic acid, acrylic acid/maleic acid copolymers, and polyacetal carboxylate.

The amount of water-soluble organic binders is not precise because their properties vary from binder to binder. Under general circumstances, however, those that exhibit binding power at a minimum concentration are usually preferred because they provide room for other desired ingredients.

According to the present invention, powdery bulking agents may also be added if needed. Exemplary bulking agents include one or more inorganic salts selected from the group consisting of sulfates, carbonates, and hydrochlorides of alkali metals or alkaline earth metals. Of these, water-soluble inorganic alkali metal salts such as sodium sulfate, sodium carbonate, and sodium chloride are particularly preferred in view that they do not adversely affect detergent power. Other useful bulking agents include water-soluble organic salts such as sodium citrate; talc, titanium oxide, calcium carbonate, zeolite, magnesium carbonate, activated clay, and kaolin.

The cleaning compositions of the present invention may also contain a variety of inorganic salts such as calcium salts and magnesium salts; as well as organic materials including surfactants, saccharides, and carboxymethylcellulose.

Optionally, the compositions of the present invention may contain from 0% to about 10%, preferably from about 0.1% to about 5%, more preferably from about 0.1% to about 2%, of a soil release agent. Such a soil release agent may be a polymer. Polymeric soil release agents useful in the present invention may include copolymeric blocks of terephthalate and polyethylene oxide or polypropylene oxide, and the like. These agents may give additional stability to concentrated aqueous, liquid compositions. Therefore, their presence in such liquid compositions, even at levels that do not provide soil release benefits, may be advantageous.

The soil release agents may include a copolymer having blocks of terephthalate and polyethylene oxide, crystallizable polyesters and polymers of the generic formula:

$$X—(OCH_2CH_2)_n—(O—C(O)—R^1—C(O)—O—R^2)_u—(O—C(O)—R^1—C(O)—O)—(CH_2CH_2O)_n—X$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. $R^2$ can be any suitable ethylene or substituted ethylene moieties. A more complete disclosure of these highly preferred soil release agents is contained in European Patent Application 185,427, the disclosure of which is incorporated herein by reference.

Bleaching Compounds

The compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, European Patent Application 133, 354, and U.S. Pat. No. 4,412,934. Preferred bleaching agents may also include 6-nonylamino-6-oxoperoxycaproic acid as described in U.S. Pat. No. 4,634,551.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) may also be used.

An example of a preferred percarbonate bleach can comprise dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate, or water-soluble surfactants. Percarbonate is available from various commercial sources such as FMC, Solvay, and Tokai Denka.

Mixtures of bleaching agents can also be used. Peroxygen bleaching agents, the perborates, the percarbonates, etc., may be combined with bleach activators, which lead to the in situ production in aqueous solution (i.e., during the washing process) of the peroxy acid corresponding to the bleach activator. Various non-limiting examples of activators are disclosed in U.S. Pat. No. 4,915,854 and U.S. Pat. No. 4,412,934. The nonanoyloxybenzene sulfonate (NOBS) and tetraacetyl ethylene diamine (TAED) activators are typical, and mixtures thereof can also be used. U.S. Pat. No. 4,634,551 describes other typical bleaches and activators that may be useful.

Amido-derived bleach activators are those of the formulae:

$$R^1N(R^5)C(O)R^2C(O)L \text{ or } R^1C(O)_n(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Examples of bleach activators of the above formulae include (6-octanamido-caproyl)oxybenzenesulfonate, (6-nonanamidocaproyl)oxybenzenesulfonate, (6-decanamido-caproyl)oxybenzenesulfonate, and mixtures thereof as described in U.S. Pat. No. 4,634,551, incorporated herein by reference.

Another class of bleach activators includes the benzoxazin-type activators described in U.S. Pat. No. 4,966, 723, incorporated herein by reference. For example, an activator of the benzoxazin-type is:

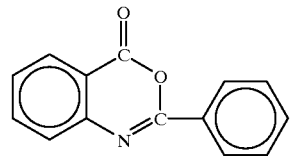

Still another class of preferred bleach activators includes the acyl lactam activators, especially acyl caprolactams and acyl valerolactams of the formulae:

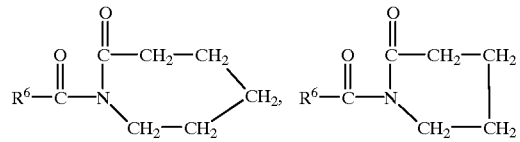

wherein $R^6$ is H or an alkyl, aryl, alkoxyaryl, or alkaryl group containing from 1 to about 12 carbon atoms. Such lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. U.S. Pat. No. 4,545,784, incorporated herein by reference, discloses acyl caprolactams, including benzoyl caprolactam, adsorbed into sodium perborate.

Bleaching agents other than oxygen bleaching agents are also known in the art and may be useful in the present invention. One type of non-oxygen bleaching agent of particular interest includes photoactivated bleaching agents such as the sulfonated zinc and/or aluminum phthalocyanines. If used, the cleaning compositions will typically contain from about 0.025% to about 1.25%, by weight, of such bleaches, such as sulfonate zinc phthalocyanine.

If desired, the bleaching compounds can be catalyzed by means of a manganese compound. Such compounds are well known to those skilled in the art.

Other preferred optional ingredients include polymeric soil release agents, materials effective for inhibiting the transfer of dyes from one fabric to another during the cleaning process (i.e., dye transfer inhibiting agents), polymeric dispersing agents, suds suppressors, optical brighteners or other brightening or whitening agents, chelating agents, fabric softening clay, anti-static agents, other active ingredients, carriers, hydrotropes, processing aids, dyes or pigments, solvents for liquid formulations, solid fillers for bar compositions, bacteriocides, colorants, perfumes, preservatives, opacifiers, stabilizers such as guar gum and polyethylene glycol, anti-shrinkage agents, anti-wrinkle agents, fabric crisping agents, spotting agents, germicides, fungicides, anti-corrosion agents, and the like.

Liquid compositions of the present invention may include a liquid carrier. The liquid carrier used in the present compositions is preferably at least primarily water due to its low cost, relative availability, safety, and environmental compatibility. The level of water in the liquid carrier is preferably at least about 50%, most preferably at least about 80%, by weight of the carrier. The level of liquid carrier is greater than about 50%, preferably greater than about 65%, more preferably greater than about 70%. Mixtures of water and low molecular weight, e.g., less than about 200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

If the composition of the present invention includes a detergent or surfactant, the compositions herein will preferably be formulated such that, during use in aqueous cleaning operations, the wash water will have a pH of between about 6.5 and about 11, preferably between about 7.5 and 10.5. Laundry products are typically at pH 9–11. Techniques for controlling pH at recommended usage levels include the use of buffers, alkalis, acids, etc., and are well known to those skilled in the art.

The following examples illustrate, but do not limit, the present invention. Unless otherwise indicated, all parts and percentages are by weight.

EXAMPLE 1

The following is an example of a laundry detergent according to the present invention. An antioxidant, sodium thiosulfate, is incorporated into the Protease Pink (Novo 6.0T) enzyme granule at 0.05% or 500 ppm of the enzyme. Thus, this antioxidant is present at a level of 10 ppm in the cleaning composition.

| INGREDIENT | Amount (wt %) |
|---|---|
| Sodium Carbonate | 38.35 |
| Pareth-25-7 | 16.65 |
| Sodium Citrate | 15.00 |
| Sodium Perborate Monohydrate | 10.00 |
| Sodium Bicarbonate | 6.25 |
| Precipitated Silica | 3.00 |
| Cellulose Gum | 2.00 |
| Tetra Acetyl Ethylene Diamine | 3.00 |
| Protease Granule | 2.00 |
| Fatty Acid Blend (Stearic Acid) | 1.00 |
| Sodium Silicate | 1.00 |
| Soil Dispersant | 1.00 |
| Silicone Granular Defoamer | 0.30 |
| Cotton Brightener | 0.25 |
| Fragrance | 0.20 |
| TOTAL | 100.00 |

EXAMPLE 2

The following is an example of a presoak and laundry booster according to the present invention. An antioxidant, sodium thiosulfate, is incorporated into the alkaline oxidatively stable protease enzyme granule at 0.05% or 500 ppm of the enzyme. Thus, this antioxidant is present at a level of 1.25 ppm in the cleaning composition.

| INGREDIENT | Amount (wt %) |
|---|---|
| Sodium Sesquicarbonate | 55.00 |
| Sodium Carbonate | 25.25 |
| Pareth-25-7 | 6.00 |
| Fumaric Acid | 4.89 |
| Sodium Salt of Anionic Terpolymer | 2.00 |
| Sodium Citrate | 1.83 |
| Sodium Perborate Monohydrate | 1.83 |
| Alkaline Stable Protease (Granule A) | 1.75 |
| Fluorescent Whitening Agent | 0.50 |
| Alkaline Stable Protease (Granule B) | 0.25 |

-continued

| INGREDIENT | Amount (wt %) |
|---|---|
| Cellulase | 0.25 |
| Alkaline Oxidatively Stable Protease Granule | 0.25 |
| Fragrance | 0.20 |
| TOTAL | 100.00 |

EXAMPLE 3

Sensory testing was conducted to determine if the presence of a stabilizer was effective to reduce malodor in cleaning compositions. Sample A was prepared according to example 1, above. Sample B was prepared according to example 1, above, except it did not contain a stabilizer. In other words, for sample B neither the enzyme granule nor the composition contained a stabilizer. A portion of sample A and B were each stored for three months at 70° F. and at 120° F. Thereafter, each sample was tested using a Triangle Test. This test is a sensory evaluation conducted by panelists trained to discern odor differences. The panelists are asked to compare three samples of a product. Two of the samples are a matched pair and the panelist is asked to choose the odd sample. If the panelist correctly chooses the odd sample, they are asked for the differences and preferences.

Thus, a Triangle test was conducted with samples A and B and all of the panelists correctly chose the odd sample. The panelists preferred the odor of the composition that contained the stabilizer. The panelists described the odor as fresher or stronger.

EXAMPLE 4

Sample C was prepared according to example 2 above. Sample D was prepared according to example 2 above, except that it did not contain a stabilizer. A portion of sample C and D were each stored for three months at 70° F., at 100° F. and 80% relative humidity, and at 120° F. A Triangle test was conducted.

With respect to the samples stored at 70° F., one-half of the panelists discerned a difference. Of those that noticed a difference, 80% indicated that sample C was more fragrant or preferable.

With respect to the samples stored at 100° F. and 80% relative humidity, 40% of the panelists discerned a difference and all of those panelists preferred sample C.

With respect to the samples stored at 120° F., 40% of the panelists discerned a difference and 75% of those panelists preferred sample C.

While there have been described what are presently believed to be the preferred embodiments of the invention, those skilled in the art will realize that changes and modifications may be made thereto without departing from the spirit of the invention. It is intended to claim all such changes and modifications that fall within the true scope of the invention.

What is claimed is:

1. A cleaning composition comprising:

a. ingredients useful for formulating laundry and cleaning compositions selected from the group consisting of cationic or nonionic fabric softening agents, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof;

b. an enzyme;

c. a perfume; and d. from about 0.0000001% to 0.001% by weight of the composition of a stabilizer selected from the group consisting of thiosulfate, thiosulfuric acid and mixtures thereof.

2. The composition of claim 1, wherein the stabilizer comprises from about 0.0001% to 0.001% by weight of said composition.

3. The cleaning composition of claim 1, wherein the composition is in the form of a powder.

4. The cleaning composition of claim 1 wherein the composition is in the form of a liquid.

5. The cleaning composition of claim 1 wherein the stabilizer is incorporated into a granule with the enzyme.

6. A method of retaining the fragrance of a fragranced cleaning composition that contains ingredients useful for formulating laundry and cleaning compositions selected from the group consisting of cationic or nonionic fabric softening agents, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof; an enzyme, and a perfume, comprising adding from about 0.0000001% to 0.001% by weight of the composition of a stabilizer selected from the group consisting of thiosulfate, thiosulfuric acid and mixtures thereof.

* * * * *